US005490466A

United States Patent [19]

Diffrient

[11] Patent Number: 5,490,466

[45] Date of Patent: Feb. 13, 1996

[54] ADJUSTABLE KEYBOARD SUPPORT

[75] Inventor: Niels Diffrient, Ridgefield, Conn.

[73] Assignee: Howe Furniture Corporation, Trumbull, Conn.

[21] Appl. No.: 213,189

[22] Filed: Mar. 15, 1994

[51] Int. Cl.[6] ..... A47B 57/00

[52] U.S. Cl. ..... 108/96; 108/50; 108/138; 248/918

[58] Field of Search ..... 108/10, 96, 7, 108/6, 19, 50, 147, 145, 138; 248/918–923

[56] References Cited

U.S. PATENT DOCUMENTS

| | | | |
|---|---|---|---|
| 3,866,866 | 2/1975 | Kneile | 108/138 X |
| 4,515,086 | 5/1985 | Kwiecinski et al. | 248/918 X |
| 4,616,798 | 10/1986 | Smeenge et al. | 248/918 X |
| 4,625,657 | 12/1986 | Little et al. | 108/138 X |
| 4,776,284 | 10/1988 | McIntosh | 108/138 |
| 5,031,867 | 7/1991 | Cotterill | 248/918 X |
| 5,083,512 | 1/1992 | Newhouse et al. | 108/50 |
| 5,176,351 | 1/1993 | Moore | 108/138 X |

*Primary Examiner*—José V. Chen
*Attorney, Agent, or Firm*—Parmelee, Bollinger & Bramblett

[57] ABSTRACT

A table top is provided with a vertically adjustable keyboard support platform which is suspended on a parallel linkage assembly. The parallel linkage rotates about a pair of rotatable pivot rods carried by the underneath side of the platform. A gas spring is connected to the linkage to block its rotation when the platform is in a desired lowered position and to aid in returning the platform to a position flush with the table top.

9 Claims, 5 Drawing Sheets

ADJUSTABLE KEYBOARD SUPPORT

TECHNICAL FIELD

This invention relates to a table top having incorporated therein a vertically adjustable keyboard support. More specifically, it pertains to such a table top especially well-adapted for use in a folding table.

BACKGROUND ART

Tables having adjustable keyboard support portions for computers or word processors are known in the art. However, the known devices are relatively complex and bulky. They often make use of springs and relatively long and unwieldy lever arms. As a result, they take up a substantial amount of room, even when in their raised positions flush with the table top. This is a particular problem in the case of folding tables. In order for a table to be folded into a compact storage configuration, it is necessary that the keyboard support mechanism take up a minimal amount of space.

DISCLOSURE OF INVENTION

The invention comprises a table top having a rectangular recess within which is housed an adjustable keyboard support, The mechanism for the keyboard support comprises parallel arms secured to rotatable pivot rods carried by the keyboard support, Means are provided for locking the pivot rods to any desired angle of rotation corresponding to a selected depression of the keyboard support below the table top.

BEST MODE FOR CARRYING OUT THE INVENTION

Figure 1:
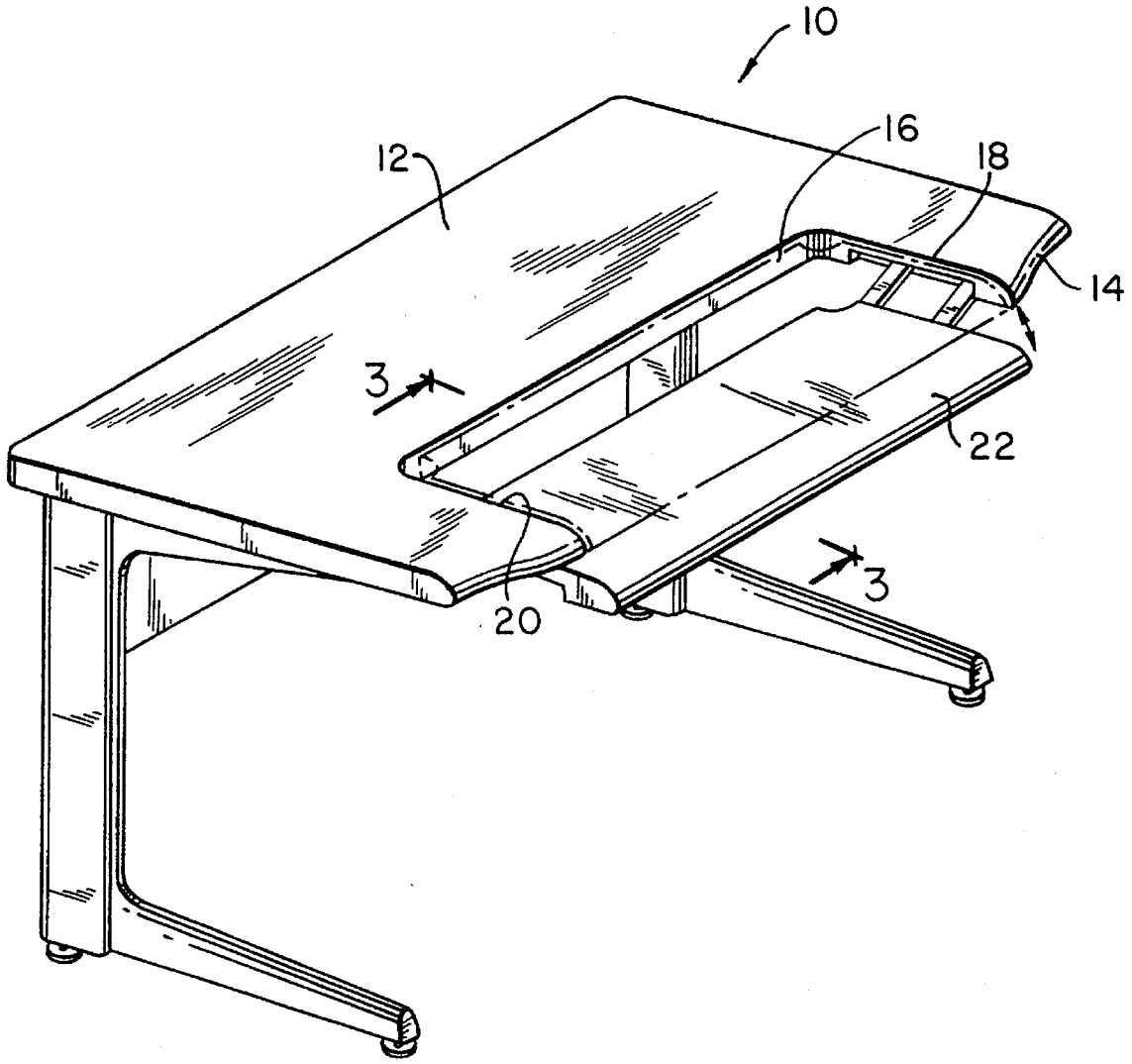
FIG. 1 is an isometric view of a table having a top and an adjustable keyboard support in accordance with the invention.

With particular reference to FIG. 1, there is illustrated a table 10 in accordance with this invention. It includes a top 12 having an edge 14 which defines a substantially rectangular recess 16. The recess 16 includes a first 18 and a second 20 end. Mounted within the recess 16 for vertical movement between a raised position flush with the table top 12 (shown in dash-dot lines) and a lowered typing position is a keyboard support platform 22.

Figure 2:
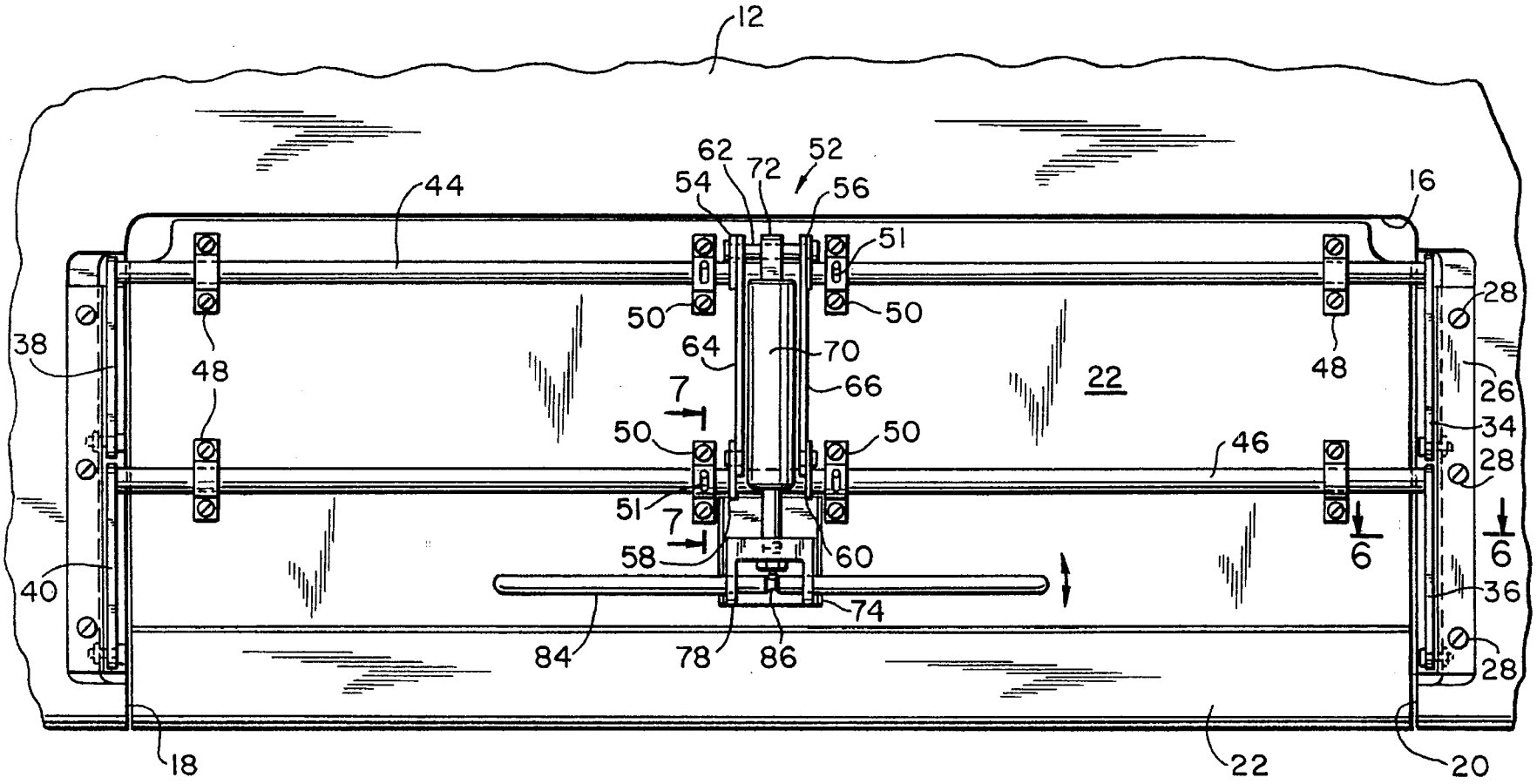
FIG. 2 is a bottom view of a portion of the table top of FIG. 1 including the keyboard support of the invention.

The keyboard support platform 22 is suspended within the recess 16 of the table top by a parallel linkage assembly. The linkage assembly may be best understood by reference to FIGS. 2, 5, and 6. The linkage assemblies at either end of the support platform 22 are substantially identical. Accordingly, only one will be described in detail. As illustrated in FIG. 6, the end 20 of the recess 16 defines a further recess 24 adjacent the lower surface of the table top 12. Within this recess is mounted an angle iron 26 which has a Z-shaped cross-section. The angle iron 26 is mounted to the bottom of the table top 12 by means of screws 28. Mounted in the wall portion of the angle iron 26 are a pair of shoulder screws 30 having enlarged allen heads 32. The shoulder screws extend into semi-spherical recesses 33 in the table top. First 34 and second 36 linkage bars are each pivotally suspended at one end from the shoulder screws 30 as illustrated in FIG. 2. As previously explained, a similar pair of third 38 and fourth 40 linkage bars are similarly suspended from the first end 18 of the recess 16 as shown in FIG. 5.

Figure 3:
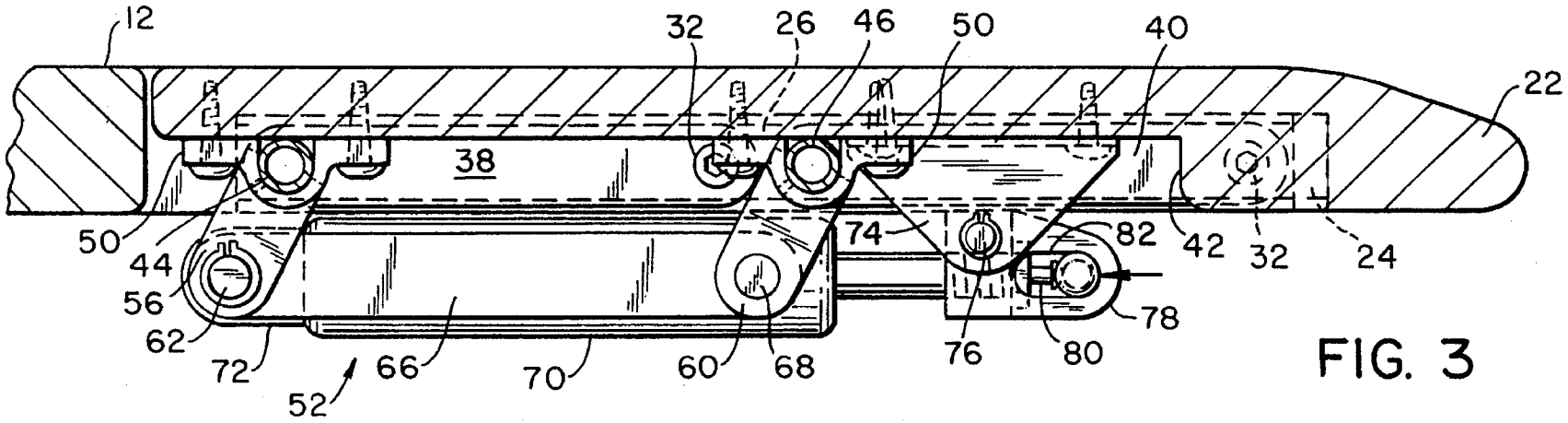
FIG. 3 is an enlarged cross-section taken substantially along the line 3—3 of FIG. 1 but showing the keyboard support in its raised position.
Figure 4:
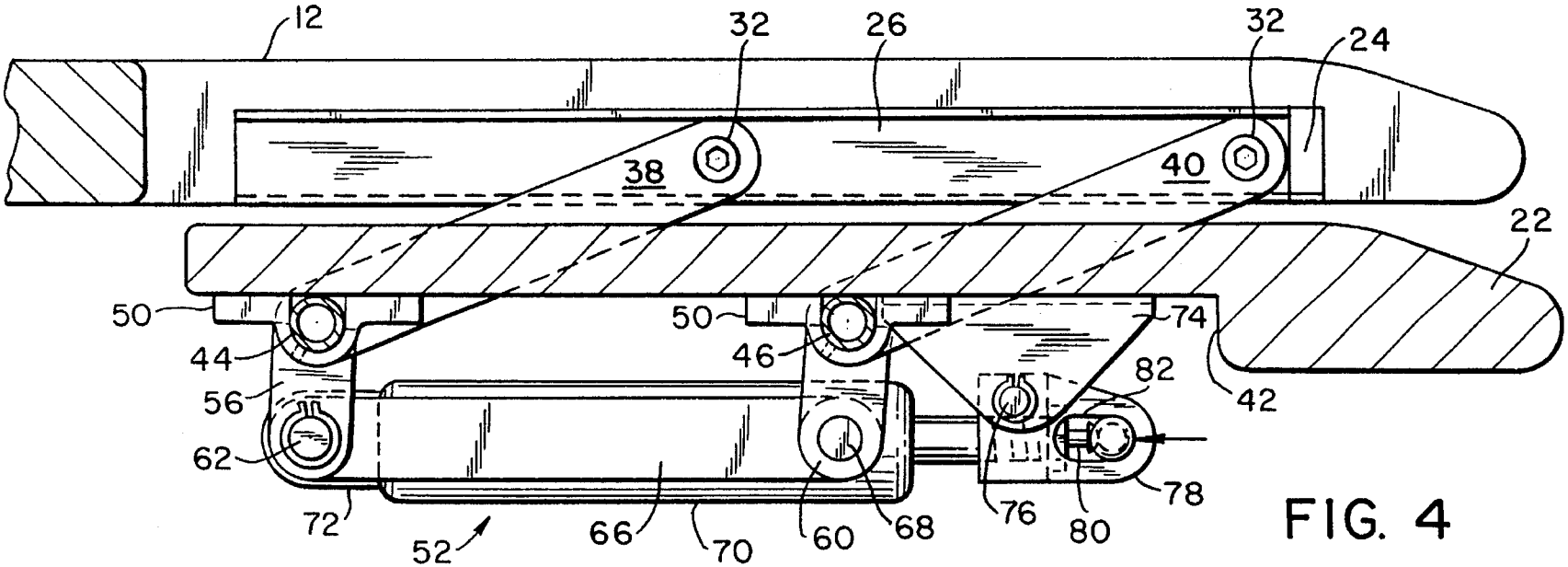
FIG. 4 is a view similar to FIG. 3 but showing the keyboard support in a depressed position.
Figure 5:
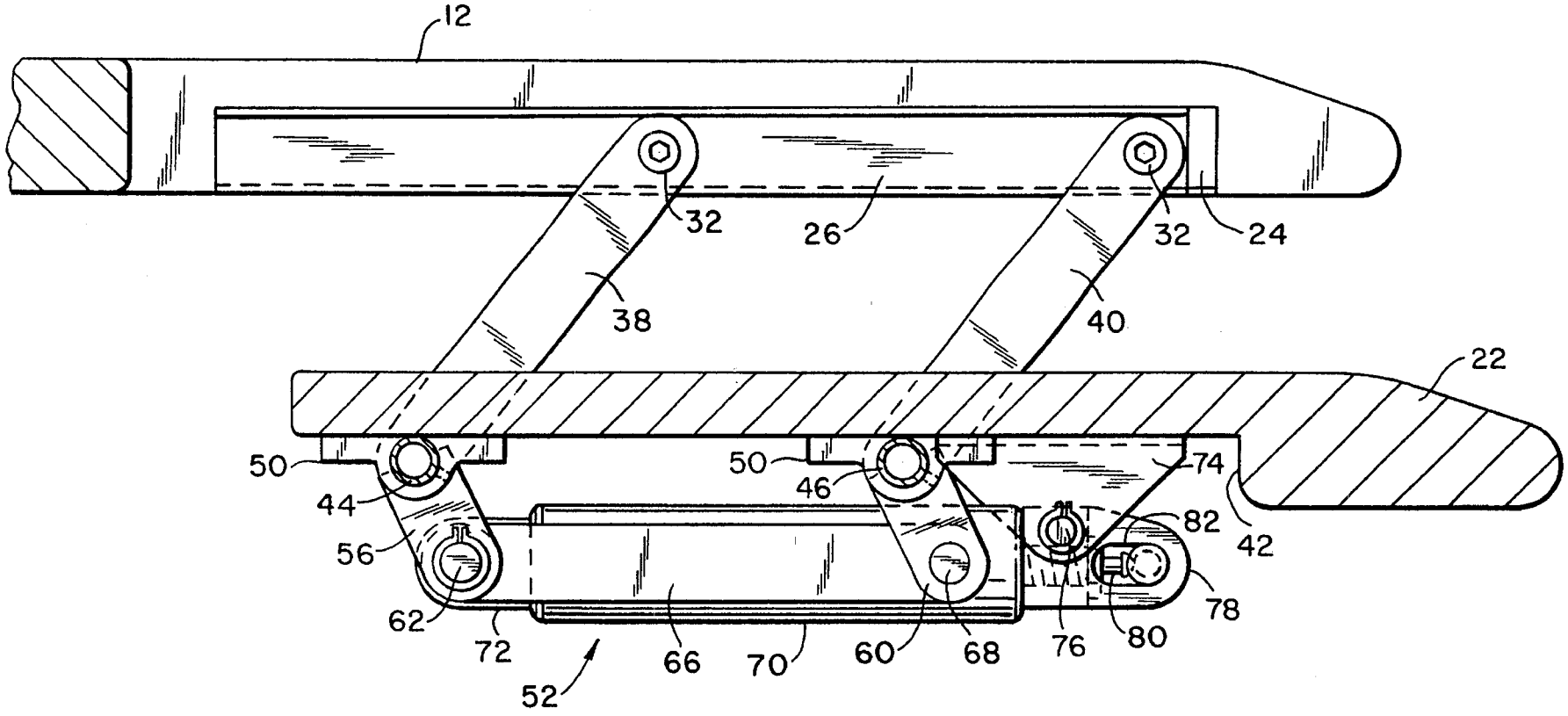
FIG. 5 is a view similar to FIGS. 3 and 4 showing the keyboard support in a further depressed position.
Figure 6:
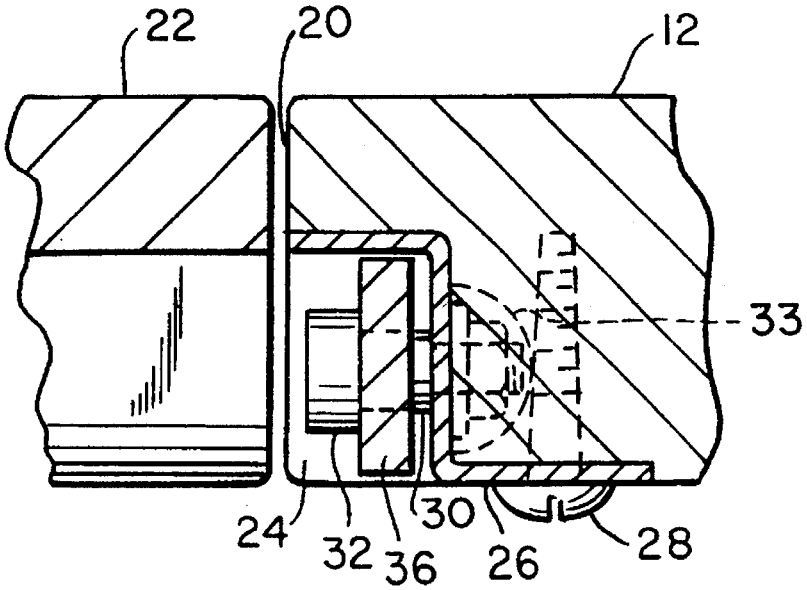
FIG. 6 is an enlarged cross-section taken substantially along the line 6—6 of FIG. 2.
Figure 7:
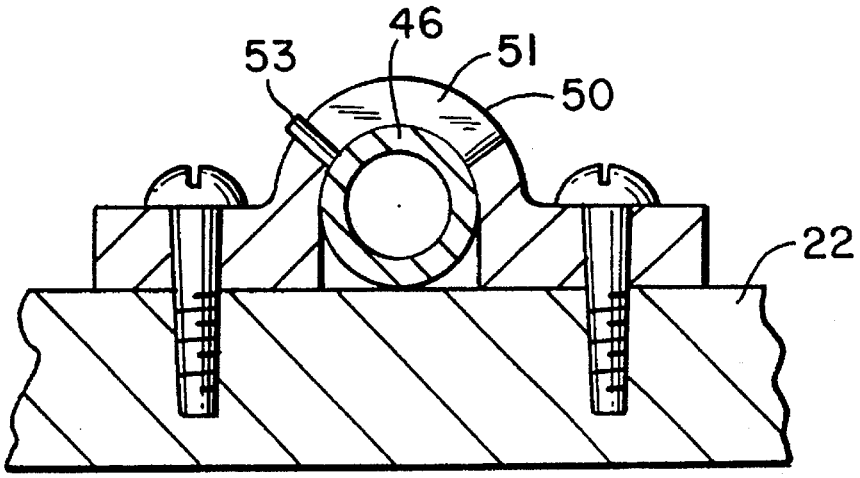
FIG. 7 is an enlarged cross-section taken substantially along the line 7—7 of FIG. 2.

Turning now to FIGS. 3–5, it will be noted that the underside of the support platform 22 is designed with a recess 42 spaced inwardly from its front edge. The purpose of this recess 42 is to compactly house the parallel linkage assembly consistent with its use in a folding table. Referring to FIG. 2, it will be noted that the underside of the support platform 22 carries a pair of parallel spaced pivot tubes or rods 44, 46. Each of the pivot rods is mounted for rotation within a pair of outboard brackets 48 and inboard brackets 50 mounted to the underside of the support platform 22. Each of the inboard brackets 50 includes a slot 51. A locating pin 53 mounted on the respective pivot rod 44, 46 extends through the slot (FIG. 7). This combination serves to prevent sidewise motion of the platform 22 along the length of the pivot rods. The ends of the pivot rods 44, 46 are fixedly secured, as by welding, to the depending ends of the respective first, second, third and fourth linkage bars 34, 36, 38, 40.

Centrally positioned on the bottom surface of the support platform 22 and intermediate the inboard brackets 50 is a locking assembly 52. The locking assembly 52 is effectively suspended between the pairs of inboard brackets 50 and below the pivot rods 44, 46 by four crank arms. A rearward pair of crank arms 54, 56 are fixedly secured, as by welding, to the pivot rod 44. A forward pair of crank arms 58, 60 is similarly secured to the forward pivot rod 46. It will now be appreciated that, although the members are fairly widely separated, the rearmost combination of linkage bars 34, 38, the pivot rod 44, and the crank arms 54, 56 function as a bell crank. The same is true of the forward combination of linkage bars 36, 40, pivot rod 46, and the crank arms 58, 60.

A pivot bar 62 extends between the rear crank arms 54, 56. Pivotally mounted on the pivot bar 62 are the respective ends of a pair of side frame members 64, 66. These side frame members are horizontally mounted with their opposite ends supported by pivots 68 in the respective forward crank arms 58, 60.

Suspended between the rear crank arms 54, 56 and the forward crank arms 58, 60 is a conventional gas spring 70. One such spring, the BLOC-0-LIFT® is available from Stabilus GmbH of Koblenz, Germany. The gas spring is characterized by infinitely adjustable blocking characteristics. One end carries a stud 72 which is pivotally mounted on the pivot bar 62 extending between the rear crank arms 54, 56. The forward end of the gas spring 70 is suspended from a U-shaped bracket 74 which is carried by the underside of the support platform 22. Suspended within the U-shaped bracket 74 from a horizontal pin 76 is a U-shaped yoke 78. The release pin 80 of the gas spring 70 extends into the yoke 78. The yoke 78 includes a pair of spaced, oval-shaped, openings 82. Supported within these openings 82 is an actuator bar 84. The actuator bar 84 carries a centrally located groove 86 (FIG. 2) which receives the release pin 80 of the gas spring 70. Accordingly, it will be noted that moving either end of the actuator bar 84 will cause it to pivot within the oval openings 82 and thereby depress the release pin 80 of the gas spring.

Operation

FIG. 3 illustrates the keyboard support platform 22 in its raised position flush with the top 12 of the table. It will be apparent that this provides a very compact assembly, taking up very little room on the underside of the table. As a result, it is particularly well adapted for use with folding type tables.

When it is desired to lower the support platform 22 into a typing position, the user simply reaches beneath the edge of the support platform 22 with either hand to contact the actuator bar 84. Rocking the bar in any direction moves its central groove as illustrated by the arrows in FIGS. 3 and 4 to depress the release pin 80, thereby releasing the gas spring 70. With the gas spring released, the support platform 22 is easily moved downward via the parallel linkage provided by the linkage bars 34, 36, 38, 40, the pivot rods 44, 46, and the crank arms 54, 56, 58, 60. Since the linkage bars and the crank arms are both fixed to the pivot rods, their relative angles do not change. As they rotate downwardly (counterclockwise as viewed in FIGS. 4 and 5) they cause the gas spring 70 to advance toward the front edge of the table toward the position illustrated in FIG. 5 which illustrates the downward limit position. The keyboard support platform 22 may be locked into any of an infinite number of locations between fully raised and fully lowered by simply releasing the actuator bar 84 to free the release pin 80. Further, when released, the gas spring supplies a lifting force to return the platform 22 to a raised position.

It is believed that the many advantages of this invention will now be apparent to those skilled in the art. It will also be apparent that a number of variations and modifications may be made therein without departing from its spirit and scope. Accordingly, the foregoing description is to be construed as illustrative only, rather than limiting. This invention is limited only by the scope of the following claims.

I claim:

1. A table top having a top surface, an underneath surface, at least one edge, and a keyboard support platform comprising:

a substantially rectangular recess formed in said table top including first and second ends extending inwardly from said edge;

a substantially rectangular, vertically adjustable, platform substantially filling said recess when in a raised position, said platform having a bottom surface and a top surface;

first and second substantially identical parallel linkage bars, each having a first end pivotally mounted in the first end of said recess and a depending second end;

third and fourth parallel linkage bars substantially identical to said first and second bars, each having a first end pivotally mounted in the second end of said recess and a depending second end;

a first rotatable pivot rod carried by said platform, said first pivot rod having first and second ends secured, respectively, to the depending ends of said first and third bars;

a second rotatable pivot rod substantially parallel to said first pivot rod, said second pivot rod having first and second ends secured, respectively, to the depending ends of said second and fourth bars; and means for locking the rotation of said pivot rods to stabilize the vertical position of said platform relative to said table top.

2. The table top of claim 1 wherein said rotation locking means comprises:

first and second spaced crank arms fixedly mounted to, and depending from, said first pivot rod; and an adjustable blocking member connected to lock the angular position of said first and second crank arms.

3. The table top of claim 2 wherein said blocking member comprises a gas spring having a first end secured to said first and second crank arms and a second end secured to said support platform.

4. The table top of claim 3 wherein the second end of said gas spring includes a release pin.

5. The table top of claim 2 additionally comprising:

third and fourth spaced crank arms fixedly mounted to, and depending from, said second pivot rod;

a first side frame member having a first end pivotally secured to said first crank arm and a second end pivotally secured to said third crank arm; and a second side frame member having a first end pivotally secured to said second crank arm and a second end pivotally secured to said fourth crank arm.

6. The table top of claim 5 wherein said blocking member comprises a gas spring mounted between said first and second side frame members having a first end secured to said first and second crank arms and a second end secured to said support platform.

7. The table top of claim 6 wherein the second end of said gas spring includes a release pin.

8. The table top of claim 7 additionally including an actuator mounted on the underneath side of said support platform and manually adjustable to selectively actuate said release pin.

9. The table top of claim 8 wherein said actuator comprises a pivotally mounted bar.

* * * * *